US006202426B1

(12) United States Patent
Matsunaga et al.

(10) Patent No.: US 6,202,426 B1
(45) Date of Patent: Mar. 20, 2001

(54) AIR CONDITIONER

(75) Inventors: Atsushi Matsunaga; Toshihiro Hotta; Hironobu Tazawa, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/471,492

(22) Filed: Dec. 23, 1999

(30) Foreign Application Priority Data

Dec. 25, 1998 (JP) ..... 10-368919
Feb. 10, 1999 (JP) ..... 11-032461

(51) Int. Cl.[7] ..... F24F 1/02
(52) U.S. Cl. ..... 62/125; 62/298
(58) Field of Search ..... 62/125, 126, 127, 62/129, 130, 259.1, 262, 298; 236/94; 165/11.1; 454/201, 202

(56) References Cited

U.S. PATENT DOCUMENTS 4,404,813 * 9/1983 Paddock et al. ..... 62/127
4,966,004 * 10/1990 Midlang et al. ..... 236/94 X
5,495,887 * 3/1996 Kathnelson et al. ..... 165/11.1
6,009,717 * 1/2000 Hernandez et al. ..... 62/262
6,018,955 * 2/2000 Kaneko et al. ..... 62/125
6,022,270 * 2/2000 Bascaran et al. ..... 454/201
6,085,538 * 7/2000 Bascaran et al. ..... 62/262
6,098,411 * 8/2000 Jeon ..... 62/125

FOREIGN PATENT DOCUMENTS 63-57456 4/1988 (JP) .
4-50325 4/1992 (JP) .
5-171856 7/1993 (JP) .

* cited by examiner

*Primary Examiner*—Harry B. Tanner
(74) *Attorney, Agent, or Firm*—Oblon, Spivak, McClelland, Maier & Neustadt, P.C.

(57) ABSTRACT

An air conditioner comprising a body of the air conditioner; an LED for displaying a running condition and so on of the air conditioner by a light, the LED is provided in an inside of the body; a front casing provided on a front side of the body; a flexible display component having a recess, the display component aesthetically formed diffuses the light from the LED; and a front panel with an intake grille having an opening portion for receiving and engaging both ends of the display component and a protrusion engaged with the recess of the display component, the front panel with the intake grille is attached to the front casing so as to be opened and closed, wherein the both ends of the display components are inserted in the opening portion of the front panel with the intake grille by curving the display component in order to fix the display component to the front panel with the intake grille.

10 Claims, 10 Drawing Sheets

AIR CONDITIONER

BACKGROUND OF THE INVENTION +ps
FIELD OF THE INVENTION

The present invention relates to structures of a front panel with an intake grille, which can be opened and closed, and of display components attached to the front panel with the intake grille.

DISCUSSION OF BACKGROUND

FIG. 16 illustrates a structure of attaching display components in a conventional air conditioner disclosed in, for example, Japanese Unexamined Patent Publication JP-A-9-4869. Numerical reference 1 designates a body of the air conditioner; numerical reference 20 designates the display components, numerical reference 4 designates a front panel with an intake grille; numerical reference 16 designates a design panel; numerical reference 17 designates a display board; and numerical reference 18 designates a holder of the display board.

In the structure of attaching the display components according to the conventional air conditioner, the display board 17 is fixed to the body 1 of the air conditioner by the holder 18. The display components 4 is fixed to an inside of the design panel 16 by fusion bond, adhesion and so on or fixed to the inside of the design panel 16 so as to be pushed by the holder 18 toward the inside.

Incidentally, FIG. 17 is a perspective view illustrating an indoor unit of a conventional air conditioner disclosed in, for example, Japanese Unexamined Patent Publication JP-A-4-50325. FIG. 18 is a side view of a panel opening and closing device of the conventional air conditioner partly broken, and FIG. 19 is an enlarged view of an important portion of the panel opening and closing device of the conventional air conditioner.

In FIGS. 17 through 19, numerical reference 1 designates a body of an indoor unit of the air conditioner; numerical reference 2 designates a front casing of the indoor unit; numerical reference 4 designates a front panel covering a front side of the front casing, the front panel can be opened and closed; numerical reference 3 designates a back casing of the indoor unit, wherein the body 1 of the indoor unit is constructed by the back casing 3, the front casing 2 and the front panel 4. Numerical reference 27 designates a shaft being an axis of rotation of the front panel 4; numerical reference 48 designates an engaging portion for engaging a lower portion of the front panel 4 with the front casing when it is closed; numerical reference 49 designates an engaging claw provided in the engaging portions 48 of the front panel 4; and numerical reference 210 designates an engaging part integrally formed with an arm 210*a*.

In the next, an operation will be described. The front panel 4 is connected to the front casing 2 by the shafts 27 so as to be opened and closed by a rotation with center at the shaft 27. At a time of closing the front panel 4, the lower portion of the front panel 4 is engaged by the plurality of engaging portions provided on left and right sides or in a center of the front casing 2. The body 1 of the indoor unit is constructed by the back casing 3, the front casing 2 and the front panel 4. The engaging part 210 in the front panel is fixed to the front casing 2 by the engaging claws 49 formed in the front casing 2. The front panel 4 rotates around the shafts 27 so as to be opened and closed in a forward direction of the front casing 2. When the front panel 4 is closed, it is engaged such that a tip of the engaging claw 49 in the front panel 4 exceeds tips of the arm 210*a* in the engaging part 210, the arms 210*a* are elastically deformed to open and close, and the tip of the engaging claw 49 is interposed between the arms 210*a*.

However, in the structure of attaching the display components according to the conventional air conditioner illustrated in FIG. 16, there are problems that workability in fixing the display components is bad and a cost can not be reduced because the display components are independently fixed, and portions attaching these are limited.

Further, in the structure of opening and closing the panel according to the conventional air conditioner illustrated in FIGS. 17 through 19 has problems that a gap A is formed as illustrated in FIG. 19 to deteriorate a look, wherein the gap A is formed in an upper mating surface between the front casing and the front panel by a warp occurred in molding the front panel when a distance between the shaft being a connecting portion and an end surface or between the shafts is long in an upper portion of the front panel because the lower portion of the front panel is engaged at a plurality of positions and the upper portion of the front panel is supported by the shafts at time of closing the front panel.

Further, at the time of opening and closing the front panel, the arms of the engaging part are spreaded and closed, whereby stress caused by spreading and closing is concentrated on the arms.

Further, in case that a positional deviation between the engaging claw of the front panel and the engaging part fixed to the front casing occurs by scattering of a size of various components, scattering caused by a condition of engagement between the various parts, or the like in opening and closing the front panel, the engaging claw is not inserted in a center of the engaging part and a biased load is applied to the arms of the engaging part, whereby there is a problem that the engaging part is broken when the front panel is opened and closed.

SUMMARY OF THE INVENTION

It is an object of the present invention to solve the above-mentioned problems inherent in the conventional technique and to provide a structure of attaching display components by which the display components are easily attached to a front panel with an intake grille at a low cost.

Another object of the present invention is to provide a structure of securely attaching the display components without a positional deviation when the display components are attached to the front panel with the intake grille.

Another object of the present invention is to obtain a device for holding the front panel with the intake grille used when the front panel is closed, the device for holding can prevent deterioration of a look.

Another object of the present invention is to relax concentration of stress on engaging parts and also to minimize an influence by a positional deviation between an engaging claw of the front panel and an engaging part fixed to the front casing.

According to a first aspect of the present invention, there is provided an air conditioner comprising a body of the air conditioner, an LED for displaying a running condition and so on of the air conditioner by a light, the LED is provided in an inside of the body, a front casing provided on a front side of the body, a flexible display component having a recess, the flexible display component aesthetically formed diffuses the light from the LED, an opening portion provided in the front casing so as to be opened and closed, to which opening portion both ends of the display component are inserted to engage therewith, and a front panel with an intake grille having a protrusion engaged with the recess of the display component, whereby the both ends of the display component is curved and inserted in the opening portion of the front panel with the intake grille.

According to a second aspect of the present invention, there is provided the air conditioner, wherein at least one of recesses of the display component and the protrusion of the front panel with the intake grille has a guiding slanted portion.

According to a third aspect of the present invention, there is provided the air conditioner, wherein the front panel with the intake grille has an engaging protrusion and an engaging opening, and a design cover having an engaging opening engaged with the engaging protrusion of the front panel with the intake grille, an engaging piece engaged with the engaging opening of the front panel with the intake grille and a display opening engaged with the display component, wherein the design cover is attached to the front panel with the intake grille such that the display component is interposed between the front panel with the intake grille and the design cover.

A fourth aspect of the present invention, there is provided the air conditioner including a structure of opening and closing the front panel with the intake grille constructed such that at least one float stopper is provided in the vicinity of left and right end portions of the front panel with the intake grille, which is provided in the body of the air conditioner so as to be opened and closed with center at an axis, or is provided on a center of an inside center of the front panel with the intake grille, and a receiving portion formed in the front casing.

According to a fifth aspect of the present invention, there is provided the air conditioner including a structure of opening and closing the front panel having at least one stopper formed in a wedge shape with respect to an orbit with the center at the axis at time of opening and closing the front panel provided in the vicinity of left and right end surfaces of the front panel with the intake grille, which is opened and closed, or at a center of an inside of the front panel with the intake grille, and a receiving portion provided in the front panel with the intake grille.

According to a sixth aspect of the present invention, there is provided the air conditioner including a structure of opening and closing the front panel with the intake grille having an engaging claw provided in the front panel with the intake grille of the body of the air conditioner, and an engaging part having an arm provided in the front casing, wherein the arm of the engaging claw is attached so as to have spaces from the engaging claw in a direction of spreading the arms.

According to a seventh aspect of the present invention, there is provided the air conditioner including the structure of opening and closing the front panel with the intake grille, wherein a pair of arms are provided in the engaging part, and a triangle thick portion is provided in the engaging claw so as to be a supporting point against a deviation, and an intermediate portion of the engaging claw is thin.

According to an eighth aspect of the present invention, there is provided the air conditioner including a structure of opening and closing the front panel with the intake grille, wherein the engaging claw of the front panel with the intake grille is arranged in a direction perpendicular to the spreading directions of the arms of the engaging part.

According to a ninth aspect of the present invention, there is provided the air conditioner including the structure of opening and closing the front panel with the intake grille having a rail slidably provided in the spreading directions of the arms or an adjusting rib provided in directions perpendicular to the spreading directions of the arms for adjusting the spaces in the perpendicular directions.

According to a tenth aspect of the present invention, there is provided the air conditioner including the structure of opening and closing the front panel with the intake grille having at least one float stopper for the front panel with the intake grille, which is opened and closed with center at an axis, provided in the vicinity of left and right end surfaces of the front panel with the intake grille at a center of an inside of the front panel with the intake grille, an engaging claw provided in the front panel with the intake grille, and an engaging part having an arm provided in the front casing, wherein the engaging claw is attached so as to have a play in a spreading direction of the arm of the engaging part.

BRIEF DESCRIPTION OF THE DRAWINGS

A more complete appreciation of the invention and many of the attendant advantage thereof will be readily obtained as the same becomes better understood by reference to the following detail description when considering in connection with the accompanying drawings, wherein.

DETAILED DESCRIPTION OF THE PREFERRED EMBODIMENT

A detailed explanation will be given of preferred embodiments of the present invention in reference to FIGS. 1 through 15 as follows, wherein the same numerical references are used for the same or similar portions and description of these portions is omitted.

Embodiment 1

Figure 1:
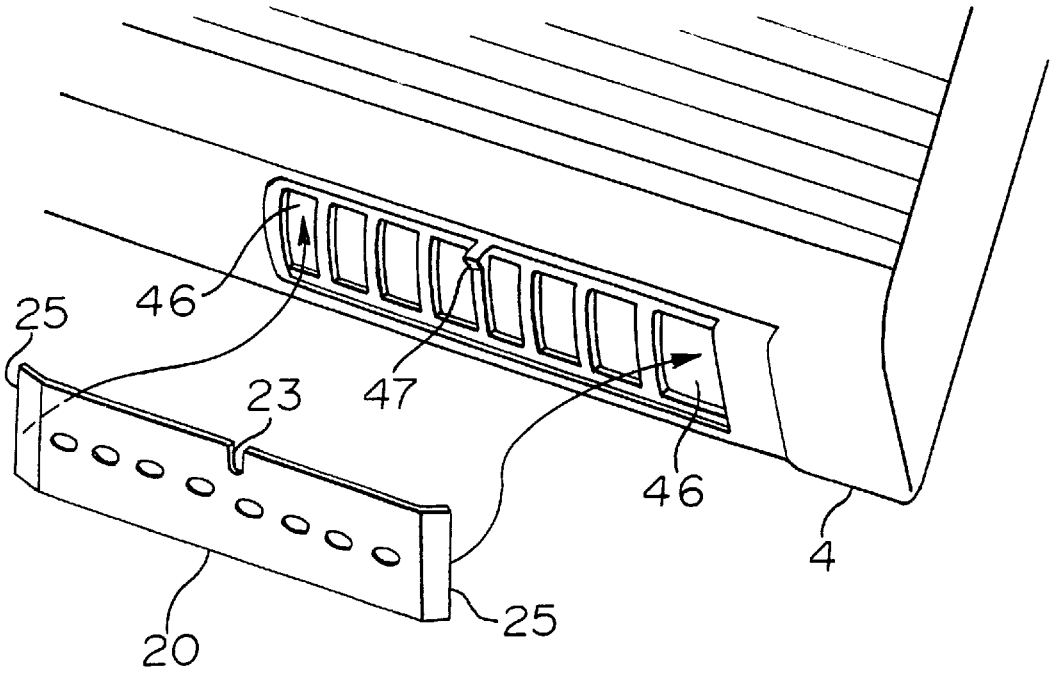
FIG. 1 is a perspective view of an important portion of an air conditioner according to Embodiment 1 of the present invention.
Figure 2:
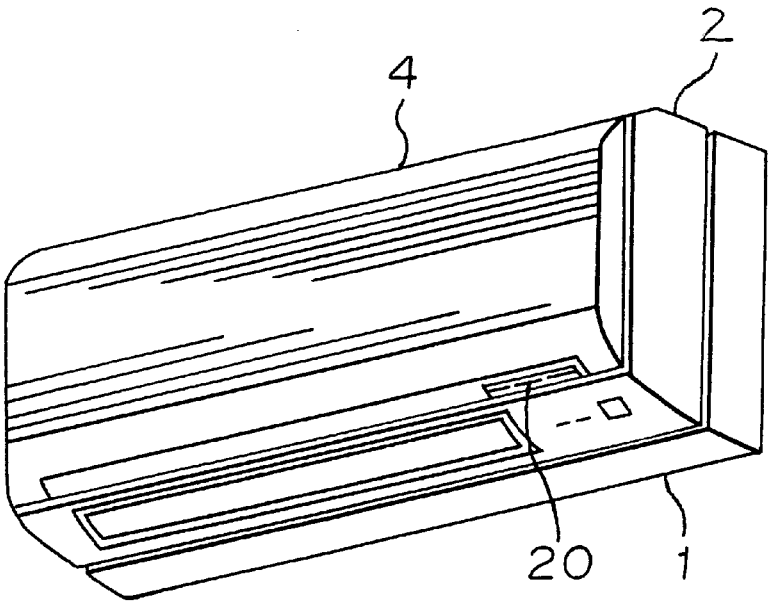
FIG. 2 is a perspective view of the air conditioner according to Embodiment 1 of the present invention.

Hereinbelow, Embodiment 1 of the present invention will be described in reference of figures. FIGS. 1 and 2 explain Embodiment 1 of the present invention. FIG. 1 is a perspective view of an important portion of an air conditioner; and FIG. 2 is a perspective view of the air conditioner. In FIGS. 1 and 2, numerical reference 1 designates a body of the air conditioner, in which a plurality of LEDs for displaying a running condition and so on by a light, is provided; and numerical reference 20 designates a display component having a recess 23 at a center of an upper portion, the display component aesthetically formed diffuses the light of the LEDs.

Numerical reference 4 designates a front panel with an intake grille having an opening portion 46 for inserting both ends 25 of the display component 20 for engaging therewith and a protrusion 47 engaged with the recess 23 of the display component 2.

In the next, an operation will be described. The display component 20 is deflected and the both ends thereof are inserted in the opening portion 46 of the front panel with the intake grille 4. Thereafter, the deflection is canceled. At this time, the recess 23 of the display component 2 is engaged with the protrusion 47 of the front panel with the intake grille 4, and simultaneously the display component 20 is engaged with the opening portion 46 of the front panel with the intake grille 4, whereby an attachment of the display component 20 to the front panel with the intake grille 4 is completed.

According to Embodiment 1, by deflecting the display component 20, the both ends are easily inserted in the opening portion 46 of the front panel with the intake grille 4. And further, the display component 20 is attached to the front panel with the intake grille 4 without a positional deviation since the recess 23 of the display component 20 is engaged with the protrusion 47 of the front panel with the intake grille.

Embodiment 2

Figure 3:
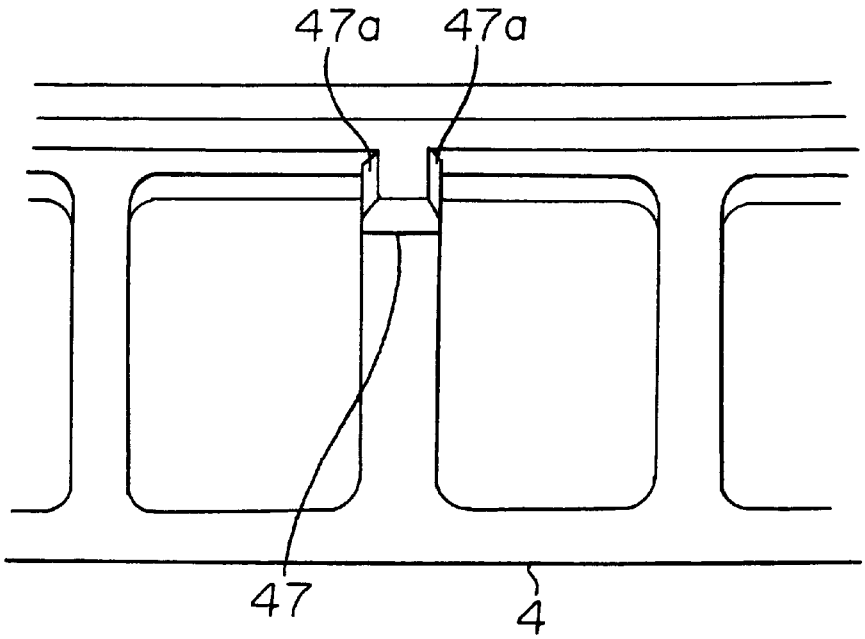
FIG. 3 is an enlarged view of an important portion of an air conditioner according to Embodiment 2 of the present invention.
Figure 4:
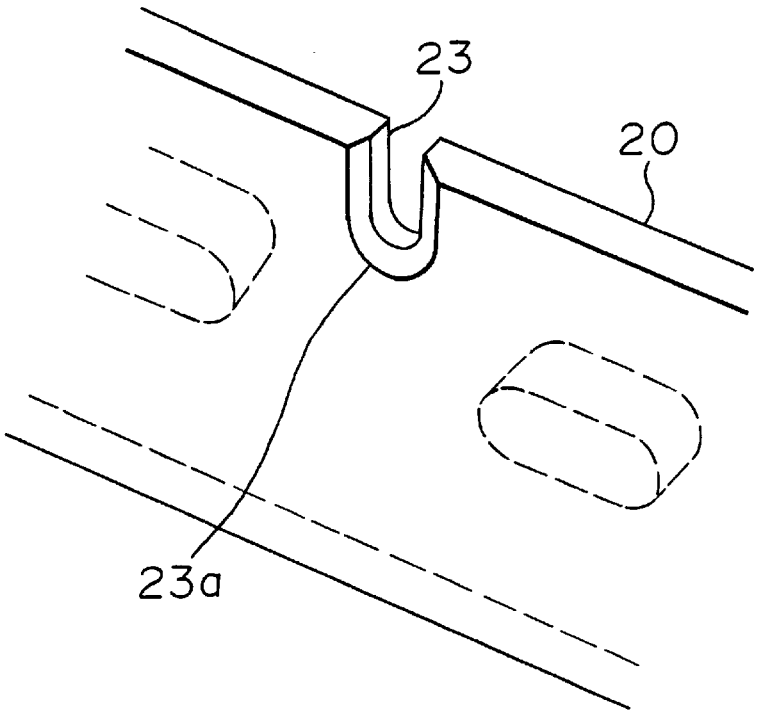
FIG. 4 is a perspective view of the important portion of the air conditioner according to Embodiment 2 of the present invention.

FIGS. 3 and 4 are perspective views of an important portion of an air conditioner for explaining Embodiment 2 of the present invention. In FIGS. 3 and 4, numerical reference 23*a* designates a guiding slanted portion provided in a recess 23 of a display component; and numerical reference 47 designate a guiding slanted portion provided in a protrusion 47 of a front panel with an intake grille 4.

In the next, an operation will be described. Both ends 25 of the display component 20 are inserted in an opening portion 46 of the front panel with the intake grille 4 after deflecting the display component 20, and thereafter the deflection of the display component 20 is canceled. At this time, the protrusion 47 is in contact with the guiding slanted portion 23*a* provided in the recess 23 of the display component 20, or the recess 23 of the display component 20 is in contact with the guiding slanted portion 47 provided in the protrusion 47 of the front panel with the intake grille 4, whereby the protrusion 47 of the front panel with the intake grille 4 is easily engaged with the recess 23 of the display component 20. Thus, an attachment of the display component 20 to the front panel with the intake grille is completed.

According to Embodiment 2, since an engagement of the display component 20 with the front panel with the intake grille 4 is guided by the contact of the protrusion 47 with the guiding slanted portion 23*a* provided in the recess 23 or a contact of the recess 23 of the display component 20 with the guiding slanted portion 47*a* provided in the protrusion 47, whereby the attachment becomes easy.

Embodiment 3

Figure 5:
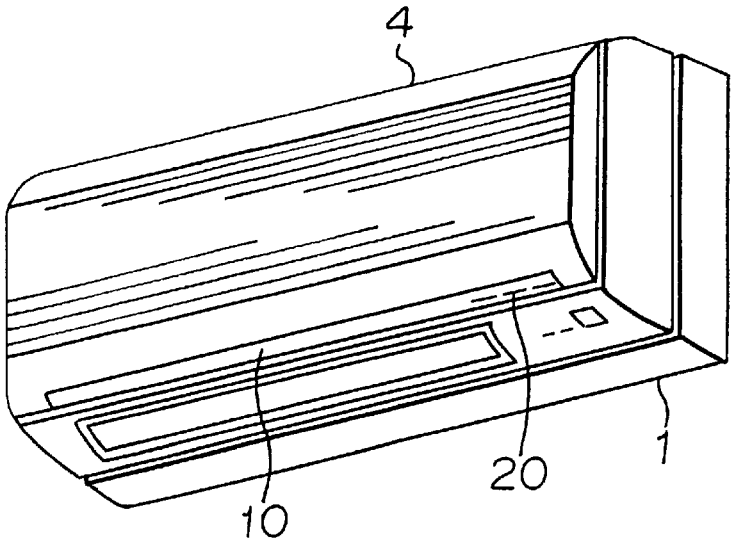
FIG. 5 is a perspective view of an air conditioner according to Embodiment 3 of the present invention.
Figure 6:
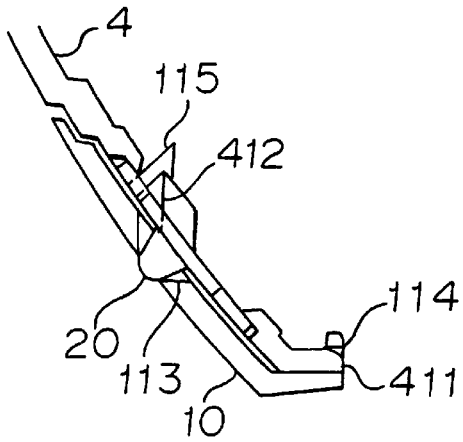
FIG. 6 is a cross-sectional view illustrating an important portion of an air conditioner according to Embodiment 3 of the present invention.

FIGS. 5 and 6 explains Embodiment 3 of the present invention. FIG. 5 is a perspective view of an air conditioner. FIG. 6 is a perspective view of an important portion of the air conditioner. In FIGS. 5 and 6, numerical references 411, 412 respectively designate an engaging protrusion and an engaging holl, both provided in a front panel with an intake grille. Numerical reference 10 designates a design cover having a display opening 113, and an engaging opening 114 and engaging piece 115 which are engaged with the engaging protrusion 411 and the engaging opening 412.

In the next, an operation will be described. After a display component 20 is attached to the front panel with the intake grille 4, the engaging protrusion 411 and the engaging opening 412 of the front grille with the intake grille 4 are respectively engaged with the engaging opening 114 and the engaging piece 115 of the design cover 10, and the display component 20 is engaged with the display opening portion 113, whereby the design cover 10 is attached to the front panel with the intake grille 4 so that the display component 20 is interposed between the front panel with the intake grille 4 and the design cover 10.

According to Embodiment 3, since the design cover 10 is attached to the front panel with the intake grille 4 so that the display component 20 is interposed between the front panel with the intake grille 4 and the design cover 10, the display component 20 is securely attached.

Hereinbelow, in Embodiments 4 through 8, a preferable structure of opening and closing the front panel and that provided with the design cover according to Embodiments 1, 2 and 3 will be described.

Embodiment 4

Figure 7:
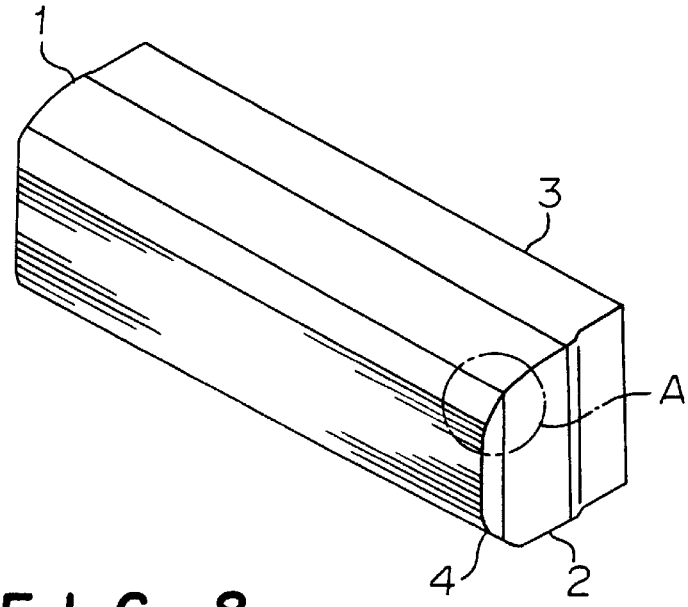
FIG. 7 is a perspective view of an air conditioner according to Embodiment 4 of the present invention.
Figure 8:
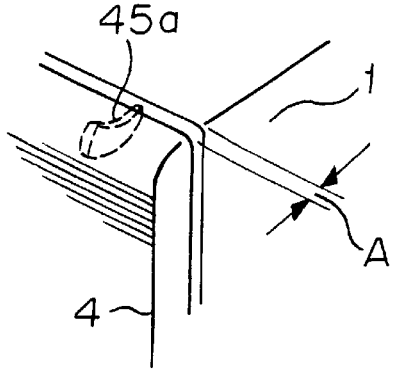
FIG. 8 is a perspective view of an important portion of a structure of opening and closing a front panel of the air conditioner according to Embodiment 4 of the present invention.

In FIGS. 7 and 8, numerical reference 1 designates a body of an indoor unit of an air conditioner; numerical reference 2 designates a front casing of the indoor unit; numerical reference 4 designates a front panel for covering a front of the front casing, the front panel is opened and closed; numerical reference 3 designates a back casing of the indoor unit. The body of the indoor unit is constructed by the back casing 3, the front casing 2 and the front panel 4. Numerical reference 45*a* designates a stopper in a wedge-like shape with respect to a circle with center at an axis center of the front panel 4, which is provided in the vicinity of left and right end surfaces of the front panel 4 or at a center of an inside of the front panel 4. Numerical reference 26 designates a receiving portion provided in the front casing 2; and numerical reference 27 designates a shaft as the axis center of opening and closing the front panel 4.

Figure 9:
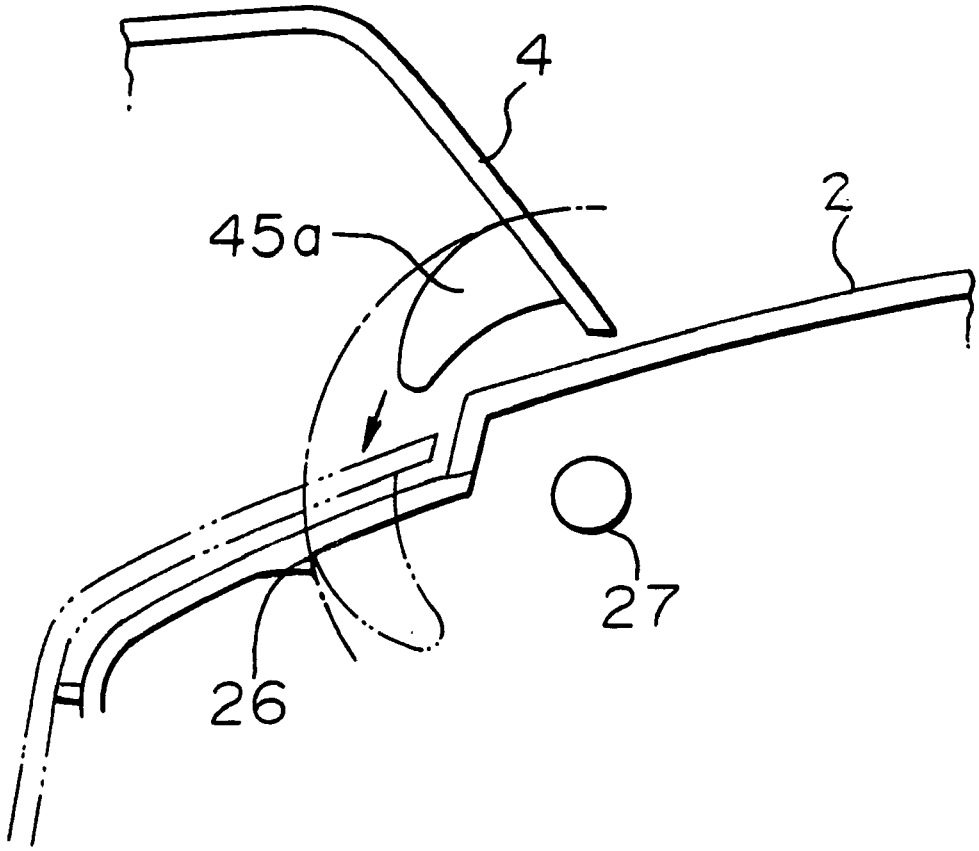
FIG. 9 is an enlarged cross-sectional view illustrating an important portion of the structure of opening and closing the front panel of the air conditioner according to Embodiment 4 of the present invention.

An operation of Embodiment 4 will be described. As illustrated in FIG. 9, when the front panel 4 is closed, the stopper 45*a* of the front panel 4 traces a rotation locus with center at the shaft 27 and thereafter is engaged with the receiving portion 26 of the front casing. Since the stopper 45*a* of the front panel 4 is in the wedge-like shape with respect to the rotation locus with center at the shaft 27, the front panel 4 is pulled toward the front casing 2 even though the front panel 4 is warped.

Embodiment 5

Figure 10:
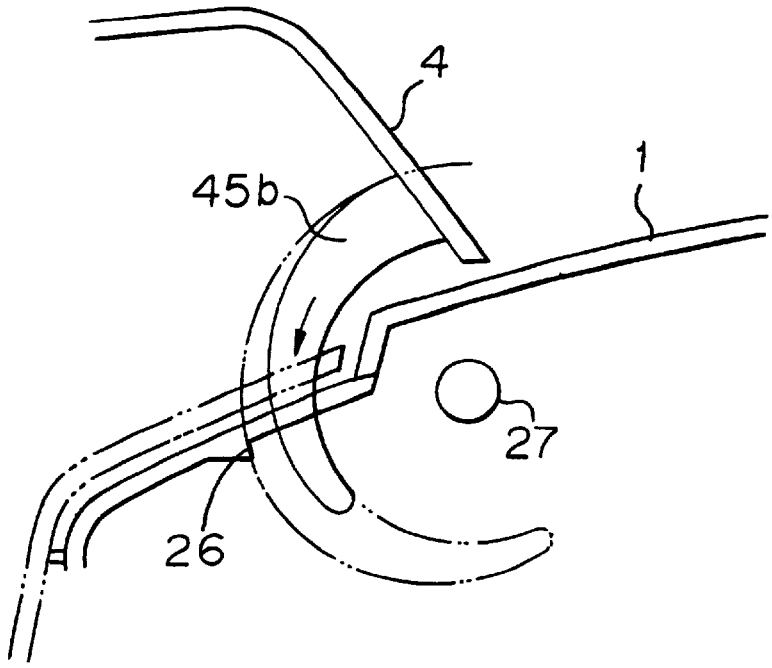
FIG. 10 is an enlarged cross-sectional view illustrating an important portion of a structure of opening and closing a front panel of an air conditioner according to Embodiment 5 of the present invention.

FIG. 10 illustrates a structure of opening and closing a front panel of an air conditioner according to Embodiment 5 of the present invention. In FIG. 10, a stopper 45*b* of the front panel 4 is longer than the stopper described in Embodiment 1. Therefore, the stopper 45*b* of the front panel 4 is engaged with a receiving portion 26 of a front casing 2 when the front panel 4 is opened.

As described, even in case that the front panel 4 is opened, the front panel 4 does not leftward and rightward shift as long as the stopper 5*b* of the front panel 4 is engaged with the receiving portion 26 of the front casing 2 since the stopper 45*b* is long toward rotation directions of the front panel 4.

Further, in case of electric apparatuses to be recycled, it is possible to prevent the front panel, a design panel and a design cover from being destroyed when the front panel is opened at time of transporting the electric apparatuses.

Embodiment 6

Figure 11:
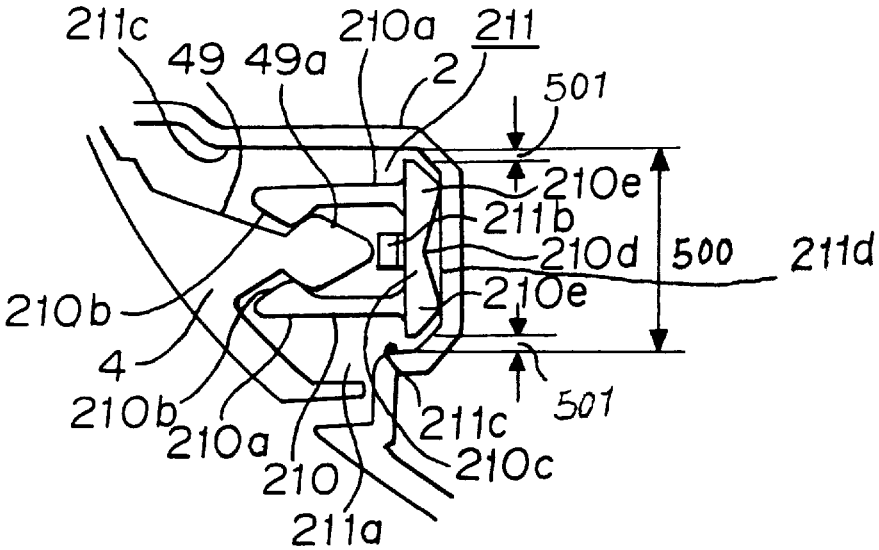
FIG. 11 is an enlarged side cross-sectional view illustrating an important portion of a structure of opening and closing a front panel of an air conditioner according to Embodiment 7 of the present invention.
Figure 12:
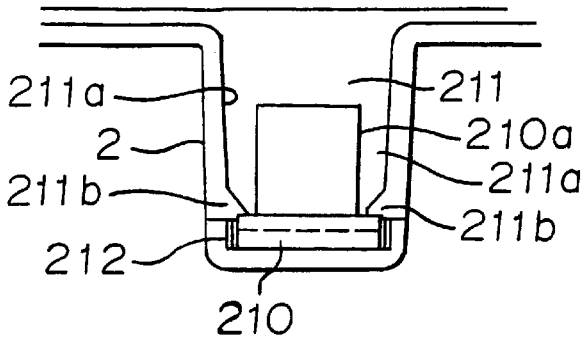
FIG. 12 is an enlarged plan cross-sectional view illustrating the important portion of the structure of opening and closing the front panel of the air conditioner according to Embodiment 7 of the present invention.

FIG. 11 is a side cross-sectional view of an important portion of a device for opening and closing a front panel of an air conditioner according to Embodiment 6 of the present invention. FIG. 12 is a plan cross sectional view of the important portion. In FIGS. 11 and 12, numerical reference 4 designates a front panel which is opened and closed; numerical reference 49 designates an engaging claw provided in a lower portion of the front panel, the engaging claw forms an arrow-like tip 49*a* protruding toward and inside of the front panel. Numerical reference 210 designates engaging parts having a pair of arms 210*a* for securing the engaging claw 49 of the front panel, the engaging part is formed by the arms having a triangular piece 210*b* directed in a securing direction at its top end so as to hold the arrow-like tip 49*a* of the engaging claw 49 and a base 210*c* for supporting the arms at the other end thereof. The base has a tin portion 210*d* at a center on the side other than that of the arms 210*a* and triangular thick portions 210*e* at around the thin portion. Numerical reference 211 designates an engaging housing having a width 500 for accommodating these engaging parts, the engaging housing is formed in a lower portion of the front casing 2. A holding claw 211*b* is protruded at an intermediate position of the vertical width 500 of a side wall 211*a*, and the engaging part 210 is held with gaps 501 from upper and lower walls 211*c*. Numerical reference 212 designates an adjusting rib provided on a bottom side of the side walls 211*a* in the engaging housing 211.

In the next, an operation of Embodiment 6 will be described. When the front panel 4 is closed, the engaging claw 49 is inserted between the arms 210*a* of the engaging part 210. The arrow-like tip 49*a* of the engaging claw 49 is inserted along the triangular pieces 210*b* at the tips of the arms while being in contact therewith so that the engaging claw 9 is fixed in alignment with a substantially center of the engaging part 210.

When the arrow-like tip 49*a* of the engaging claw 49 is inserted along the triangular pieces 210*b* at the tips of the arms, the arms 210*a* of the engaging part 210 are spreaded and simultaneously the thin portion 210*d* is elastically deformed, whereby the arms vertically open or close.

When the closed front panel 4 is opened, a relationship between the engaging claw 49 and the engaging part 210 follows a process adverse to described above.

Further, even though a deviation between the positions of the engaging claw 49 of the front panel 4 and the engaging part 210 occurs by a scattering of dimensions of components or by a scattering caused by an engagement between the components, at time of opening and closing the front panel 4, it is possible to manage and suppress the positional deviation by the gaps 501 and the adjusting rib 212 so that the engaging claw 49 is correctly inserted in the engaging part 210 without destroying the engaging part 210.

Incidentally, although the front casing 2 and the engaging part 210 are separate components, it is possible to omit a fractionating work in recycling in use of a same resin material for the front casing 2 and the engaging part 210.

Embodiment 7

Figure 13:
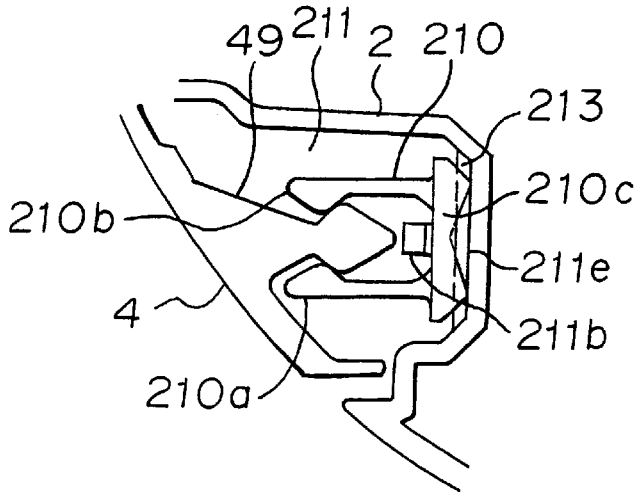
FIG. 13 is an enlarged side cross-sectional view illustrating an important portion of a structure of opening and closing a front panel of an air conditioner according to Embodiment 8 of the present invention.
Figure 14:
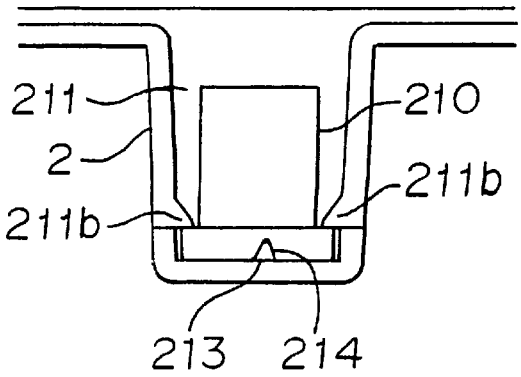
FIG. 14 is an enlarged plan cross-sectional view illustrating an important portion of a structure of opening and closing a front panel of an air conditioner according to Embodiment 9 of the present invention.

FIG. 13 is a side cross-sectional view of an important portion of a device for opening and closing a front panel of an air conditioner according to Embodiment 7 of the present invention. FIG. 14 is a plan cross-sectional view of the important portion. In FIGS. 13 and 14, numerical reference 213 designates a rib provided substantially at a center of a front wall 211*d* of an engaging housing 11 on a longitudinal direction of the engaging housing 211. Numerical reference 214 designates a groove provided in a base 210*a* of an engaging part 210 in the longitudinal direction so as to be engaged with the rib.

Thus, the engaging part 210 is arranged substantially at the center of the engaging housing 211 without leftward and rightward deviating.

Embodiment 8

Figure 15:
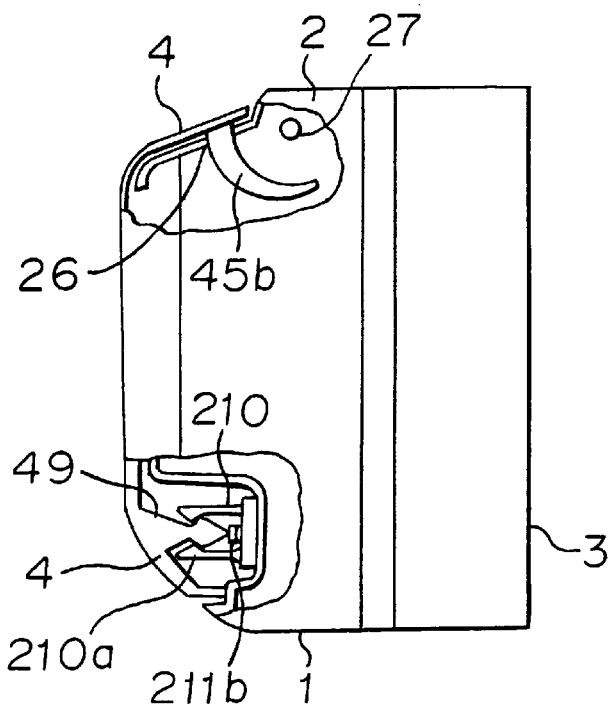
FIG. 15 is a side view partly broken illustrating an air conditioner according to Embodiment 10 of the present invention.
Figure 16:
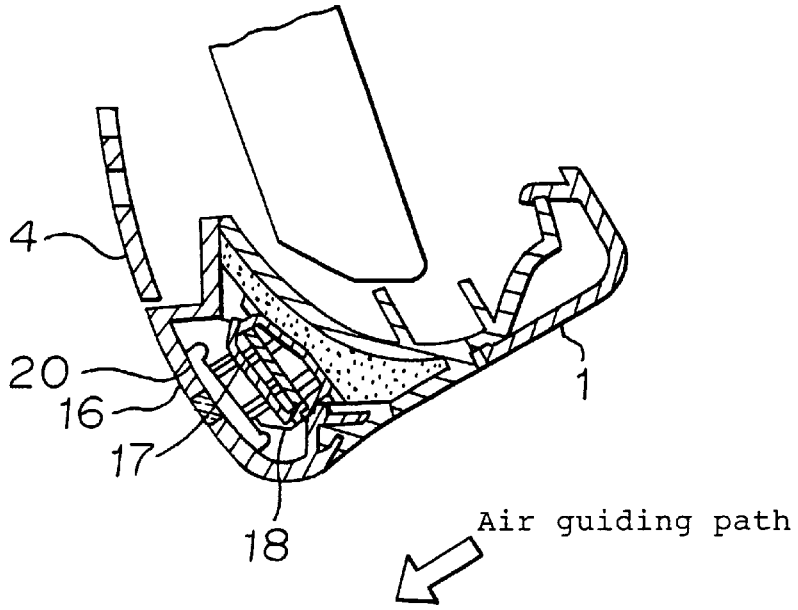
FIG. 16 is a cross-sectional view of a part of a conventional air conditioner.
Figure 17:
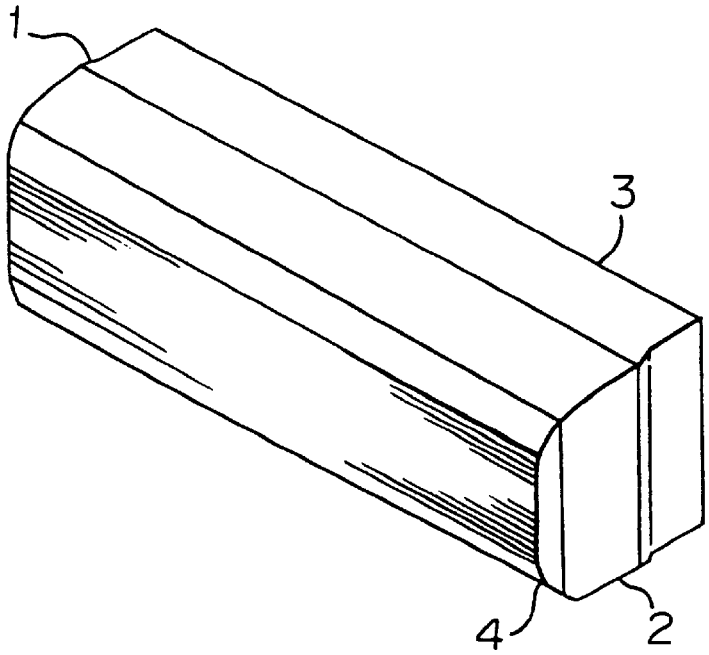
FIG. 17 is a perspective view illustrating a conventional air conditioner.
Figure 18:
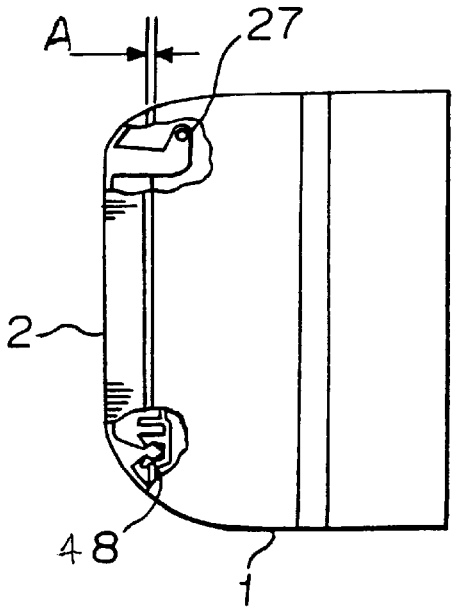
FIG. 18 is a side view partly broken illustrating the conventional air conditioner.
Figure 19:
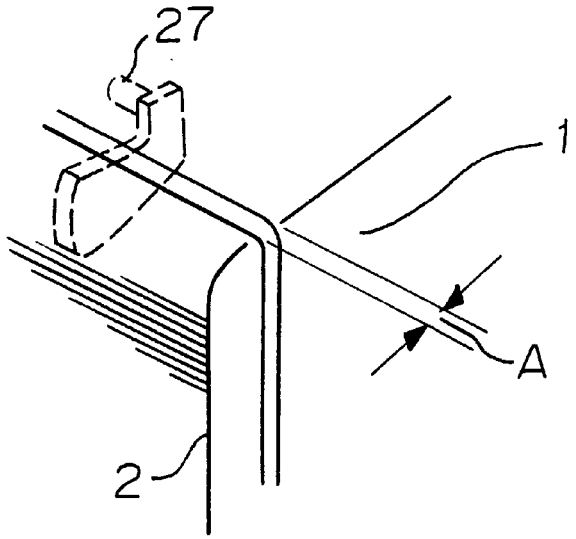
FIG. 19 is an enlarged perspective view illustrating a structure of opening and closing a front panel of the conventional air conditioner.
Figure 20:
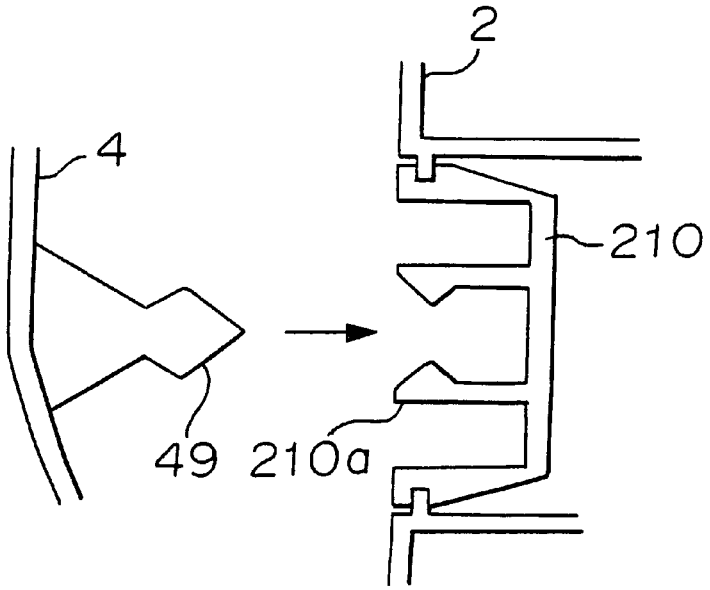
FIG. 20 is an enlarged cross-sectional view illustrating an important portion of the structure of opening and closing the front panel of the conventional air conditioner.

FIG. 15 is a side view of a device for opening and closing a front panel of an air conditioner partly broken for showing cross-sections according to Embodiment 8 of the present invention. When the front panel 4 is closed to be tightly in contact with a front casing 2, a stopper 45 is engaged with a receiving portion 26 of the front casing 2 at a wedge-like portion, and simultaneously an arrow-like tip 49*a* of an engaging claw 49 is inserted in an engaging part 210 along triangular claws 210*b* at tips of arms 210*a* while being in contact with the triangular claws 210*b*.

In the next, an operation will be described. When the front panel is opened and closed, because a stopper 45*b* is engaged with a front casing 2, the stopper regulates a rotation of the front panel 4 with center at a shaft 27 of the front casing 2 and a vertical deviation of the front panel 4 with respect to the front casing 2.

Further, when the front panel 4 is closed, the engaging claw 49 is securely held by the arms 210*a* even though upward and downward positional deviations occur between the engaging part 210 and the front panel 4 because the positional deviation is managed by gaps 501.

Incidentally, FIG. 15 illustrates a case that structures described in Embodiments 4, 5, 6 and 7 are simultaneously used, whereby a leftward and rightward deviation and an upward and downward deviation of the front casing 2 are managed in positioning the front panel 4 at time of opening and closing the front panel 4.

The first advantage of the air conditioner according to the present invention is that the display component can be easily attached to the front panel with the intake grille without a positional deviation at a low cost.

The second advantage of the air conditioner according to the present invention is that the display component is securely attached to the front panel with the intake grille.

The third advantage of the air conditioner according to the present invention is that the parts made of different materials can be easily disassembled and demolished.

The fourth advantage of the air conditioner according to the present invention is that it is possible to prevent deterioration of an outer look of the air conditioner because the front panel is drawn on a side of the front casing so that a gap between the front panel and the front casing is constantly maintained.

The fifth advantage of the air conditioner according to the present invention is that a scattering of a deviation of a load to the engaging part and of engaging force at time of opening and closing the front panel is suppressed even though a positional deviation between the engaging claw of the front panel and the engaging part fixed to the front casing occurs.

The seventh advantage of the air conditioner according to the present invention is that a scattering of engaging force by a deviation of a load to the engaging part can be suppressed even though a positional deviation occurs between the engaging claw of the front panel and the engaging part fixed to the front casing.

The seventh advantage of the air conditioner according to the present invention is that a scattering of a closed state of the front panel at time of opening and closing the front panel is reduced because the engaging claw pulls the engaging part toward a center of the engaging part by the gap provided in the attaching portion of the engaging part.

The eighth advantage of the air conditioner according to the present invention is that upward and downward movements of the engaging part are smoothly realized without changing attaching directions of the engaging part, and a load in other than the opening and closing directions is not applied to the arms of the engaging part.

The ninth advantage of the air conditioner according to the present invention is that the front panel is held with leftward and rightward deviations from the front casing being absorbed and with upward and downward deviations being absorbed at time of positioning the front panel in an opened state and a closed state.

What is claimed is:

1. An air conditioner comprising:

a body of the air conditioner;

an LED for displaying a running condition and so on of the air conditioner by a light, the LED is provided in an inside of said body;

a front casing provided on a front side of said body;

a flexible display component having a recess, the display component aesthetically formed diffuses the light from said LED; and a front panel with an intake grille having an opening portion for receiving and engaging both ends of said display component and a protrusion engaged with said recess of said display component, the front panel with the intake grille is attached to said front casing so as to be opened and closed, wherein said both ends of said display components are inserted in said opening portion of said front panel with the intake grille by curving said display component in order to fix said display component to said front panel with the intake grille.

2. The air conditioner according to claim 1, wherein a guiding slanted portion is provided in at least one of said recess of said display component and said recess of said front panel with the intake grille.

3. The air conditioner according to claim 1, wherein said front panel with the intake grille includes an engaging protrusion, an engaging opening, and a design cover including an engaging opening engaged with said engaging protrusion of said front panel with the intake grille, an engaging piece engaged with said engaging opening of said front panel with the intake grille and a display opening engaged with said display component, wherein, said design cover is attached to said front panel with the intake grille so that said display component is interposed between said front panel with the intake grille and said design cover.

4. The air conditioner according to claim 1, further comprising:

at least a single float stopper for said front panel with the intake grille, being rotatably opened and closed with respect to said body of the air conditioner with center at a shaft for opening and closing, provided in the vicinity of left and right end surfaces of said front panel with the intake grille or at a center of an inside of said front panel with the intake grille, wherein said front casing includes a receiving portion for said float stopper.

5. The air conditioner according to claim 1, further comprising:

at least a single stopper shaped like a wedge along a circular orbit of said front panel with the intake grille with center at a shaft for opening and closing provided in the vicinity of left and right end surfaces of said front panel with the intake grille or at a center of an inside of said front panel with the intake grille, wherein said front casing includes a receiving portion for said stopper.

6. The air conditioner according to claim 1, wherein said front panel with the intake grille is rotatably opened and closed with respect to said body of the air conditioner, said front casing includes an engaging part having an arm, and said front panel with the intake grille includes an engaging claw, which allows gaps from said arm in spreading directions of said arm.

7. The air conditioner according to claim 6, wherein said engaging part includes a pair of arms, said engaging claw includes a triangular thick portion and a thin middle portion, and said pair of the arms and said triangular thick portion are served as a supporting point against a deviation between said front panel with the intake grille and said front casing.

8. The air conditioner according to claim 6, wherein said engaging claw of said front panel with the intake grille is arranged in a direction perpendicular to the spreading direction of said arm of said engaging part.

9. The air conditioner according to claim 6, further comprising:

a rail for sliding said engaging part in the spreading direction of said arm or an adjusting rib arranged in a direction perpendicular to the spreading direction of said arm, said rail or said adjusting rib adjusts gaps in the direction perpendicular to the spreading direction of the arm.

10. The air conditioner according to claim 1, wherein said front panel with the intake grille is rotatably opened and closed with respect to said body of the air conditioner with center at a shaft of opening and closing, at least a single float stopper is provided in the vicinity of left and right end surfaces of said front panel with the intake grille or at a center of an inside of said front panel with the intake grille, and an engaging part having an arm is provided to secure said front panel with the intake grille with a play in a spreading direction of said arm.

* * * * *